US005631116A

United States Patent [19]

Uchida et al.

[11] Patent Number: 5,631,116

[45] Date of Patent: May 20, 1997

[54] CARRIER FOR ELECTROPHOTOGRAPHIC USE

[75] Inventors: Masafumi Uchida; Kishio Tamura; Tsuneo Daidoji, all of Hachioji, Japan

[73] Assignee: Konica Corporation, Tokyo, Japan

[21] Appl. No.: 728,665

[22] Filed: Oct. 10, 1996

Related U.S. Application Data

[63] Continuation of Ser. No. 278,316, Jul. 21, 1994, abandoned.

[30] Foreign Application Priority Data

Aug. 23, 1993 [JP] Japan ..... 5-207983

[51] Int. Cl.[6] ..... G03G 9/113

[52] U.S. Cl. ..... 430/108; 430/106.6; 430/137; 428/407

[58] Field of Search ..... 430/108, 106.6, 430/137, 138; 428/407

[56] References Cited

U.S. PATENT DOCUMENTS

| | | | |
|---|---|---|---|
| 4,265,995 | 5/1981 | Mammino | 430/108 |
| 4,272,601 | 6/1981 | Tokura et al. | 430/108 |
| 5,071,725 | 12/1991 | Kubo et al. | 430/108 |

FOREIGN PATENT DOCUMENTS

| | | | |
|---|---|---|---|
| 0266697 | 5/1988 | European Pat. Off. | 430/111 |
| 63-2078 | 1/1988 | Japan | 430/108 |
| 63-2077 | 1/1988 | Japan | 430/108 |

OTHER PUBLICATIONS

Grant & Hackh's Chemical Dictionary, 5th Ed., R. Grant et al. Ed. McGraw–Hill Book Co. NY (1987) p. 22.

Patent & Trademark English Language Translation of Japanese Patent 63–2077 (Pub. Jan. 7, 1988).

English Abstract of Japanese Patent 59–104664 (Pub. Jun. 16, 1984).

*Primary Examiner*—Janis L. Dote

*Attorney, Agent, or Firm*—Finnegan, Henderson, Farabow, Garrett & Dunner, L.L.P.

[57] ABSTRACT

A carrier for electrophotographic use is disclosed. The carrier has a resin-coated layer on the surface of the core member. The resin forming the coated layer contains a polymer prepared by copolymerizing an alicyclic methacrylate monomer and a chain-type methacrylate monomer. A high quality image can stably be obtained extending over a long period of time when the carrier is used in continuous developing.

19 Claims, 1 Drawing Sheet

CARRIER FOR ELECTROPHOTOGRAPHIC USE

This is a continuation of application Ser. No. 08/278,316, filed Jul. 21, 1994, now abandoned.

FIELD OF THE INVENTION

This invention relates to a carrier applicable to an development of an electrostatic latent image formed in an electrophotography.

BACKGROUND OF THE INVENTION

Heretofore, an electrostatic latent image formed in an electrophotography has been mainly developed in a dry type development process. The dry type development process is divided into two types; namely, one in which a single-component type developer mainly comprising magnetic tone is used, and the other in which two-component type developer comprising non-magnetic toner and magnetic carrier.

The latter type developer is preferably used from such a viewpoint that a desired electric charge can be provided by mechanically stirring toner and carrier. Such a magnetic carrier as mentioned above is required to have a proper frictional chargeability, a fuidity, a developability and a high durability in a long-term use and, besides, it is so desired as not to damage an image-forming member surface in the courses of carrying out a contact-development, a cleaning treatment and so forth.

Accordingly, Japanese Patent Publication Open to Public Inspection (hereinafter referred to as JP OPI Publication) Nos. 60-66264/1985 and 60-66265/1985, for example, propose respectively the resin-coated carriers each prepared by coating and then drying a solution containing a dissolved resin on the surface of a core-member comprising a ferromagnetic metal or the oxide thereof. The above-mentioned carriers have a high resistance. Therefore, the carriers can prevent an electrostatic latent image disorder produced by an outflow of a charge from the latent image, and the carriers can also prevent a carrier adhesion to an image-forming member when a charge is applied from a development sleeve. Further, the carriers have many advantages including, for example, such an advantage that the surface of an image-forming member cannot be damaged in the courses of carrying out a contact-development and a cleaning treatment.

However, the photographic characteristics of a carrier, such as a frictional chargeability, fluidity, developability and durability, are greatly influenced by the kinds of resins capable of forming a coated layer and, besides, the processes for forming a coated layer. Accordingly, JP OPI Publication No. 59-104664/1984 proposes a technique for forming a resin-coated carrier, in which the core-member surface of a carrier is coated with an independent polymer prepared, in a wet process such as a dipping, spraying or fluidized-bedding process, by polymerizing a monomer of cycloalkyl methacrylate that is an aliphatic methacrylate, or a copolymer of the above-mentioned monomer and a monomer of styrene, vinyl acetate, vinyl chloride or the like. The same JP OPI Publication also describes that a carrier excellent in frictional chargeability and fluidity and, particularly in moisture resistance can be prepared.

The above-mentioned resin-coated carrier described in JP OPI Publication No. 59-104664/1984 has such an advantage that the moisture resistance is excellent and that the outflow of a charge from a latent image can be reduced. On the other hand, however, there is such a problem that the adhesive property to the core-member of a resin-coated layer is poor, and that the core-member is bared by peeling a coated layer out of the core-member in a long-term use. Therefore, toner is spent on the bared core-member so as to deteriorate a chargeability in a long-term use.

According to the studies made by the inventors, when using the above-mentioned aliphatic methacrylate independently, it is liable to serious abrasion, due to the stress given by a developing unit or the like. Thereby, the charged level is suddenly dropped from the point of time when the coated layer has a certain thickness. Therefore, it is not suitable for a long-life developer.

On the other hand, JP OPI Publication No. 63-37360/1988 proposes a technique for forming a resin-coated layer, in which polymethyl methacrylate prepared by polymerizing a methyl methacrylate monomer, i.e., a chain-type methacrylate monomer that is served as the fine particles of resin, and the fine particles of resin are fixed to the surface of a carrier core member by applying a mechanical impact that is so-called a dry process. Also, JP OPI Publication No. 63-235965/1988 proposes a technique for forming a resin-coated layer, in which polystyrene-methyl methacrylate prepared by copolymerizing a chain-type methacrylate monomer, i.e., a methyl methacrylate monomer, and a styrene monomer, that is served as the fine particles of resin, and the fine particles of resin are fixed to a carrier core member by applying a mechanical impact, in the same dry process. The above-mentioned JP OPI Publication No. 63-235965/1988 describes that the resin of the resulting coated layer is excellent in adhesive property to the core member, that the coated layer is formed in a dry process by fixing the fine particles of the resin with a mechanical impact to the core member and, therefore, that a highly durable carrier can be provided without producing any delamination of the coated layer even in long-term use.

However, the above-mentioned chain-type methacrylate polymer coated-layer is hydroscopic in the material of itself. Therefore, when making use of a developer containing a carrier provided with the above-mentioned coated-layer under the highly humid conditions after preserving it for a long time, or when an image formation is carried out for a long time under the highly humid conditions, there may raise such a problem that an image quality is deteriorated by producing the leakage of charge, that a fog is produced on the background, or that a carrier adhesion is produced. The adhesive force of a toner to a carrier surface is high under the highly humid conditions (due to the influence of a moisture adsorption). Therefore, there may also raise such a problem that a toner is liable to be spent on a carrier surface.

According to the studies made by the inventors, when the above-mentioned chain-type methacrylate polymer is used independently, it is allowed to say that a coated-layer cannot be abraded at all. Therefore, there may raise such a problem that the chain-type methacrylate polymer has a limited function to remove a spent toner, and that the charged amount thereof is gradually lowered.

SUMMARY OF THE INVENTION

This invention is proposed by taking the above-mentioned actual situations into consideration. It is, accordingly, an object of the invention to provide a carrier for electrophotographic use, that is capable of maintaining a high charge even under the highly humid conditions, without producing any delamination of a coated layer from a core member, and is excellent in antispending property of toner, so that a stable chargeability can be maintained in long-term use and a high durability can also be provided.

Another object of the invention is to provide a carrier for electrophotographic use, in which a fluidity and developability can be excellent extending over a long time when the carrier is used in a developer, so that high-quality images can stably be obtained.

DETAILED DESCRIPTION OF THE INVENTION

Figure 1:
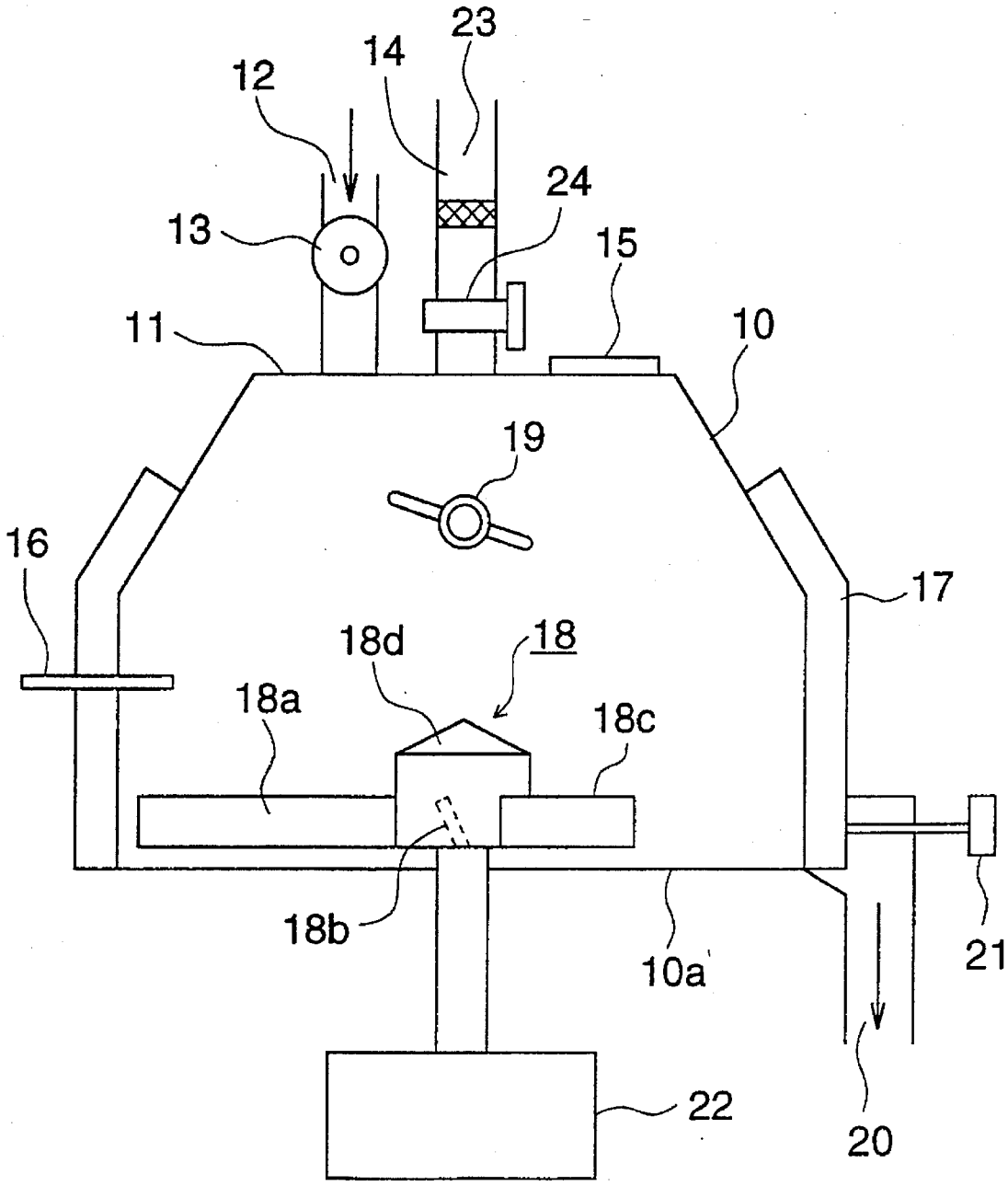
FIG. 1 is an illustration of a high-speed stirrer-mixer applicable to the manufacture of a carrier of the invention.

The above-mentioned objects of the invention can be achieved with a carrier for electrophotographic use having a resin-coated layer on the surface of the core member thereof, wherein the resin forming the coated-layer contains a polymer prepared by copolymerizing an alicyclic methacrylate monomer and a methacrylate monomer to be copolymerized with the alicylic methacrylate monomer.

The objects of the invention can also be achieved with a carrier for electrophotographic use having a resin-coated layer on the surface of the core member thereof, wherein the resin forming the above-mentioned coated layer mixedly contains a polymer prepared by polymerizing an alicyclic methacrylate monomer and a polymer prepared by polymerizing a methacrylate monomer.

A carrier of the invention for electrophotographic use is excellent in fluidity, developability and frictional chargeability, because a resin-coated layer peculiar to the invention is formed on the surface of the core member thereof and it can display a high durability without producing any delamination of the coated layer nor any deterioration caused by a moisture absorption in a long-term use. In other words, a carrier of the invention for electrophotographic use comprises a coated layer containing both of an alicyclic methacrylate component that is excellent in moisture resistance without deterioration in a long-term use under the highly humid conditions and a chain-type methacrylate component that is particularly excellent in adhesive property to the core member thereof without producing any delamination even in a long-term use. Therefore, the marked electrophotographic characteristics can be displayed by the synergistic effects of the components.

A particularly remarkable synergistic effect is that, when a surface layer is fatigued by making spent toner and the like adhered to the surface of a coated layer in use, the fatigued surface layer is so removed by bits as to refresh and restore it to the initial conditions, so that a high durability can be maintained.

The reason why the above-mentioned synergistic effect can be displayed may be considered as follows. A polymer prepared by polymerizing an alicyclic methacrylate monomer is liable to abrasion in its nature, and a polymer prepared by polymerizing a chain-type methacrylate monomer is hardly abraded in its nature. The both natures thereof can be balanced by copolymerizing or blending each of the polymers. A very small abrasion of the above-mentioned balanced surface layer is so-called a "refresh effect".

A spent toner removal made by the above-mentioned refresh effect displayed on a carrier-coated layer can greatly contribute to the high durability of a developer, particularly in the case of a spent toner having a substantially wide specific surface area, that is, for example, a toner containing an external additive such as silica, titanium or alumina, a charge leakage produced by a moisture absorption can be prevented so as to contribute to a high durability of a developer.

As for the core members of a resin-coated carrier of the invention, the following materials can be used, namely; a substance ferromagnetized to the orientation of a magnetic field, including a metal showing a ferromagnetism such as iron, nickel and cobalt as well as iron, ferrite and magnetite, and an alloy or compound containing a metal mentioned above; and an alloy not containing any ferromagnetic element, but showing a ferromagnetism when it is suitably heat-treated, including a so-called Heusler's alloy such as a manganese-copper-aluminium alloy and a manganese-copper-tin alloy, and chromium dioxide.

The above-mentioned "ferrite" herein generically means a magnetic oxide containing iron and shall not be limited to a spinel type ferrite represented by a chemical formula, $MxOy.Fe_2O_3$ (in which x=an integer of 1 to 2 and y=an integer of 1 to 3). In the above-given chemical formula, M represents a metal of monovalency to tervalency and M include concretely nickel, copper, zinc, manganese, magnesium and lithium.

Ferrite is low in magnetic susceptibility and few in possibility of damaging a small particle-sized toner. Therefore, the durability of a developer can be improved. Also, when changing the composition of the metal components contained in ferrite, a variety of magnetic characteristics thereof can be obtained, so that a carrier can readily be obtained so as to meet any purposes. As ferrite powder is of an oxide, the specific gravity thereof is less and lighter than those of a metal powder such as iron powder and nickel powder. Therefore, the impact thereof to toner is substantially weak, so that the durability of carrier can more be improved.

In an external magnetic field of 1000 Oe, ferrite is preferable to have a saturated magnetic susceptibility within the range of 10 to 80 emu/g and a magnetic coercivity is within the range of 0.1 to 100 Oe. Ferrite is also preferable to have an intrinsic resistibility within the range of $1\times10^{-6}$ to $1\times10^{-11}$ Ω·cm, a specific gravity within the range of 4.0 to 5.5 and a void within the range of 1.0 to 10%. When making use of a magnetic fine particle having the above-mentioned characteristics, a further excellent durability can be obtained.

The aforementioned core member is to have a particle size within the range of, preferably 30 to 200 μm and, more preferably 40 to 80 μm. It is further preferable that the configuration thereof is of the spherical form, from the viewpoints of a fluidity, developability and a prevention of an image-forming member from being damaged, when the core member constitutes a developer.

Next, the resins for forming a coated layer on the aforementioned core member include, for example, a resin containing not less than 50% by weight of a polymer prepared by copolymerizing an alicyclic methacrylate monomer and a methacrylate monomer to be copolymerized with the alicylic methacrylate monomer in a mol ratio within the range of 1:9 to 9:1 and, preferably 3:7 to 7:3.

The above-mentioned copolymer may be copolymerized with a styrene type monomers such as styrene, α-methyl styrene and parachlorostyrene, as well as with an alicyclic methacrylate monomer and a methacrylate monomer to be copolymerized with the alicylic methacrylate monomer. When this is the case, a styrene type monomer is to be used in a proportion of less than 50 mol % to the alicyclic methacrylate monomer and the monomer to be copolymerized with the alicyclic methacrylate monomer.

The above-mentioned alicyclic methacrylate monomers include, for example, those having each a cycloalkyl ring having 3 to 7 carbon atoms, such as cycloalkyl methacrylate, cyclobutyl methacrylate, cyclopentyl methacrylate, cyclohexyl methacrylate and cycloheptyl methacrylate.

However, from the viewpoint for displaying the aforementioned refresh effect of the surface of the aforementioned carrier, it is preferable to make use of a cyclohexyl methacrylate with a cycloalkyl ring having 6 carbon atoms.

As for the methacrylate monomers each subject to be copolymerized with an alicyclic methacrylate monomer, the following monomers may be included, for example, those of methyl methacrylate, ethyl methacrylate, propyl methacrylate, n-butyt methacrylate, hexyl methacrylate, octyl methacrylate and 2-ethyl hexyl methacrylate.

However, from the viewpoint of the refresh effect on the surface of the aforementioned carrier, it is preferable to make use of the monomers each having a methyl group, a ethyl group, a propyl group, a butyl group, a pentyl group, a hexyl group having 1 to 6 carbon atoms.

As for the resins for forming a coated layer on a carrier core member, they include, for example, those containing not less than 50% by weight of a mixture of a polymer prepared by independently polymerizing the alicyclic methacrylate monomer and a polymer prepared by independently polymerizing the methacrylate monomer in a ratio by weight within the range of 1:9 to 9:1 and, preferably 3:7 to 7:3.

As mentioned above, in addition to the above-mentioned specific resins, the other resins may also be contained, in a proportion of less than 50% by weight, in a resin for forming a coated layer of a resin-coated carrier of the invention. The above-mentioned other resins applicable thereto include, for example, a styrene type resin, an acrylic type resin, a styrene-acrylic type resin, a vinyl type resin, an ethylene type resin, a rosin-denatured resin, a polyamide resin and a polyester resin. These resins may also be used in combination.

The processes for preparing a resin-coated carrier of the invention shall not be limitative, but the processes thereof may be roughly classified into a wet process and a dry process. In the wet process, a coated layer is formed in the following manner. A resin dispersed liquid is prepared in a suspension-polymerization process, an emulsion-polymerization process or the like and the resulting resin dispersed liquid is coated on a carrier core member in a dip-coating process, a spray-coating process, a fluidized-bed coating process or the like. After then, the coated matter is heated up to a point of not lower than the glass transition point of the resin so as to be dried up; or, a resin solution prepared by dissolving a resin available on the market in an organic solvent is coated on a core member in the same coating process as mentioned above, and the core member is so heated as to be dried up, so that a coated layer can be formed.

In the above-mentioned dry process such as an emulsion-polymerization process or a suspension-polymerization process, a polymerization is made under stirring operation, so that the fine particles of a resin having a particle-size of not larger than a 1/10th size of a carrier core member (usually having a particle-size within the range of 0.1 to 2.0 μm) can be synthesized, or the fine particles of a resin is obtained by pulverizing and classifying the synthesized resin and the resulting fine particles of the resin is mixed with the core member. The mixture thereof is fixed to the surface of the core member by applying a mechanical impact. The resin fixed to the core member is heated up, if required, to a point not lower than the glass transition point of the resin, and is then dried up, so that a coated layer can be formed. In the above-mentioned dry process, the fine particles of a resin are each mixed with a core member in an amount within the range of 0.1 to 10 parts by weight and, preferably 0.3 to 5 parts by weight to 100 parts by weight of the core members. The resulting mixture is stirred to be mixed up by making use of a pulverizing machine having a rotor and a liner, such as a "Turbo-mill" (manufactured by Turbo Industrial Co.), a pin-mill, and "Kryptron" (manufactured by Kawasaki Heavy-Industrial Co.), or, preferably a high-speed stirring-mixing machine shown in FIG. 1, so that the fine particles of resin are fixed to the surface of the core member by applying a mechanical impact under stirring-mixing operation so as to form a coated layer.

The schematic construction of the high-speed stirring-mixing machine shown in FIG. 1 was as follows.

In the figure, referential numeral 11 is the top cover of the main body, to which raw material putting inlet 12, putting valve 13, filter 14 and check-up window 15 were attached. From raw material putting inlet 12, a specific amount of carrier core member particles and fine particles of resin were put in. The raw material put therein is stirred by horizontal rotation member 18 driven by motor 22. The rotation member 18 was fixed with stirring blades **18*a*, 18*b* and 18*c* each arranged to the center 18*d* of rotation member 18 with an angular interval of 120°. The stirring blades were each equipped slantwise about 35° to the bottom surface 10*a*. Therefore, when the stirring blades 18*a*, 18*b* and 18*c* were rotated at a high speed, the raw material was scraped upward to be collided against the inner wall of the upper part of main body vessel 10 and then dropped down. During the dropping down, however, the raw material was collided against vertical rotation member 19, so that the raw material was accelerated to be stirred and a cohered matter was also pulverized. In the figure, 17 was a jacket for thermostatic control, 16 was a thermometer, 20 was a product delivery outlet, 21 and 24 were each a product delivery valve, and 23** was an exhaust gas outlet provided to the inside of the vessel.

Incidentally, as mentioned before, the primary particle size of the aforementioned fine particles of resin is to be within the range of 0.01 to 2.00 μm. When the particle size thereof is smaller than 0.001 μm, the fine particles of resin cannot be securely struck into a core member and, when it exceeds 2.00 μm, any uniform coated layer cannot be formed. A weight average molecular weight Mw of a resin for forming a resin-coated layer is to be preferably within the range of 10,000 to 800,000. In this case, an abrasion resistance of a resin-coated layer is increased and, at the same time, a refresh effect is also increased, so that a durability is so increased that a high image quality can stably be obtained extending over a long period. The above-mentioned particles sizes of the core member and fine particles of resin represent each a volumetric average particle size. The particle sizes of the core members were each measured through a laser-diffraction type grain-size distribution measurement instrument, "HELOS" (manufactured by Nihon Electron Industrial Co.), and the particle sizes of the fine particles of resins were each measured through a laser scattering type grain size distribution measurement instrument, "LAP-3100" (manufactured by Ohtsuka Electron Co.).

For realizing an efficient refresh effect, a ratio of weight average molecular weight Mw to number average molecular weight Mn, Mw/Mn, is particularly preferable to be within the range of 1.5 to 10.0. When the above-mentioned molecular weights are expressed in terms of a softening point, it becomes within the range of 150° to 300° C. The measurements of each molecular weight were carried out through a gel permeation chromatography (GPC). The softening points were measured through a flow-tester (manufactured by Shimazu Mfg. Works) and the results thereof were each expressed in terms of a temperature obtained from the time when starting a flow to the time when the plunger descended by 5 mm, (at that time, the load was 20 Kgf, the orifice size was 1×1 mm and the temperature raising rate was 6° C./min.).

For stably keeping a refresh effect in any surroundings, it is particularly preferable that a moisture content at 22° C. and 55% RH is to be within the range of 0.1 to 1.0% by weight in the environment of a resin applicable to form a coated layer of a resin-coated carrier. The above-mentioned moisture content was measured in such a manner that a subject resin was allowed to stand for 24 hours under the conditions of 22° C. and 55% RH and was then measured in a loss-on-drying method in which a hot-air drying stove was used. The above-mentioned moisture content can be represented by the following formula;

$$\text{Moisture content}=(W1-W2)\div W1\times 100$$

wherein W1 represents a weight of a resin before dried; and W2 represents a weight of the resin after dried at 105° C. for 3 hours in a hot-air drying stove.

With a resin for forming a coated layer of a resin-coated carrier of the invention, the glass transition temperature (Tg) thereof is to be within the range of 60° to 180° C. and, preferably 80° to 150° C. When a Tg is lower than the above-mentioned range, a toner spent becomes so serious that any refresh effect cannot efficiently be obtained. When a Tg is higher than the range, a cast-coating property becomes so deteriorated that a carrier-coated layer surface cannot be peeled off by bits, but is peeled off every considerably large unit, so that a high durability can hardly be achieved.

A toner, together with a carrier of the invention, can constitute a developer. The toner comprises a resin in which a colorant is dispersed. As for the resin, various kinds of thermoplastic resins may be used. Among them, a polyester having a strong negative-chargeability is preferable from the viewpoint that a positive-chargeability can readily be generated from an acrylic component of a carrier-coated layer. Such a polyester as mentioned above can characteristically show a stable chargeability for a long period of time, especially in such a system that an external additive is added to a toner. To be more concrete, even in the case where an external additive having a negative chargeability on the surface of a toner is buried in or eliminated from the toner, a negative chargeability can be secured because of the characteristics of the polyester, it is, therefore, advantageous either in the case of a copy-mode (such as a mode having a low photographic density of an original document) in which a developer remains in a developing unit for a long time, or in the case where a recovered toner is reused.

A polyester serving as the above-mentioned resin for toner use is particularly preferable to have an acid value within the range of 30 to 80 mg·KOH/g. In this case, a positive chargeability can readily be generated from the acrylic component of a carrier-coated layer, so that a charging speed can preferably be accelerated.

The above-mentioned acid value can be herein defined as follows.

An acid value means the numbers of milligrams of potassium hydroxide necessary to neutralize an acid (having a carboxyl group made present at the terminal of the molecule of the acid) contained in one gram of a sample. Such an acid value as mentioned above is to be measured in conformity with JIS K 0070.

The concrete examples of the aforementioned colorants include carbon black, a nigrosine dye, aniline-blue, chalcoil-blue, chromium-yellow, ultramarine-blue, methylene-blue, rose bengal, phthalocyanine-blue, or the mixtures thereof.

To a toner, inorganic fine particles are externally added. The external additive can function as a fluidizer for a developer and, besides, it can contribute to a refresh effect on a carrier. As for the inorganic fine particles, those of hydrophobic silica, hydrophobic titanium and hydrophobic alumina may be used. Among them, a combination use of those having two different particle sizes is particularly preferred from the viewpoint of the stability of carrier refreshment. For example, a mixture of silica/titanium or a mixture of silica/alumina is preferred from the viewpoints that the initially charged amount of a developer may not become too large, and that the environmental dependency of the charged amount may be reduced.

For more excellently displaying a "refresh effect" of the invention, it is preferable that an external additive to be applied to a toner is to have a primary particle size within the range of 5 to 100 nm, and that the external additive is to be added to the toner, in a proportion within the range of 0.1 to 5% by weight. When such an external additive is of the different kind mixture type, The mixture proportion thereof is preferable to be within the range of 0.5 to 1.5, as well as in the proportions of silica/titanium and silica/alumina.

For further excellently displaying a "refresh effect" of the invention, it is preferable that a surfactant remained in a resin-coated carrier of the invention is to be within the range of 5 to 1000 ppm to the whole coated-resin and, particularly 5 to 400 ppm thereto.

The reason thereof may be assumed to be that the remaining surfactant functions as a proper rupturing point of a very small amount of abrasion.

As for the surfactants among those of the anionic type, an alkylbenzene sulfonic acid compound is preferred, and sodium alkylbenzene sulfonate or sodium alkylbenzene disulfonate is particularly preferred, from the viewpoint that a chargeability may not be affected so much.

There may be various methods to be considered for controlling an amount of a surfactant remained in a resin-coated carrier. Among those methods, the following method is preferable, wherein an amount of a surfactant, that is to be used when polymerizing a resin, is so controlled to have a concentration within the range of 0.05 to 5.00% by weight in an aqueous solution and is also controlled, after completing the polymerization, by carrying out a washing treatment through an ultrafiltration device.

An amount of a surfactant remained in a coated resin may be measured in the following manner. A coated resin of a carrier is dissolved in methyl ethyl ketone and a carrier core member is fixed by making use of a magnet, so that the resulting solutions are sampled all. The solution is added by methanol, so that the resin is precipitated and filtrated. The filtrated solution is condensed so as to be used as a solution subject to the test. A quantitative analysis is carried out in a high-speed liquid chromatography, under the following measurement conditions.

Column : GS-30, 7.6 mm, ID×500 mm

Column temperature: 30° C.

Moving phase : methanol/0.2M, aqueous NaCl solution= 85/15, pH=2.5 (adjusted with conc. phosphoric acid)

Flow rate : 1 ml/min.

Detector used : UV240 nm

Amount sampled : 20 μl

The quantitative analysis is carried out in terms of a peak area.

For still further excellently displaying a "refresh effect" of the invention, it is preferable that an amount of monomers remained in a resin-coated carrier of the invention is to be within the range of 10 to 2000 ppm to the whole coated-resin and, particularly 10 to 1000 ppm thereto. By satisfying the above-mentioned preference, a very small amount of abrasion can stably be kept on.

There may be various methods to be considered for controlling an amount of a monomer remained in a coated resin to be 10 to 1000 ppm. One of the examples thereof may be a method of controlling a monomer when a resin is polymerized. When making an emulsion-polymerization, it is preferable to use such a method that a resin is polymerized and is then subjected to an azeotropic treatment with water, in the state of an emulsion. Another example thereof may be a method of controlling a residual monomer in the step of coating a resin on a carrier core member. Among the methods, it is preferable to make use of a method of raising a resin temperature upto about the glass transition temperature (Tg) of the resin when the resin is coated. The temperature thereof is particularly preferable to be within the range of (Tg of a coated resin−10° C.) to (Tg of the coated resin+30° C.). When the temperature is about the Tg, a residual monomer can effectively be controlled, because the micro-Brownian movement of a resin molecular chain becomes so violent that the monomer is volatilized so that the movement can be accelerated.

A residual monomer can be measured in a gas chromatography (by making use of Model GC-15A manufactured by Shimazu). As the standard component applicable thereto, the same monomer as that for obtaining a polymer is used. A coated resin of a resin-coated carrier, that is subject to the measurement, is dissolved in acetone containing DMF (by making use of a supersonic washing device) and the carrier core member is fixed by making use of a magnet, so that every solution is sampled. The resulting solution is filtrated and the filtrated liquid is used as a test liquid. The test liquid is put into a test device and is then measured in an internal standard method, by making use of a column, DB-1 manufactured by J&W Co.

EXAMPLES

Now, the invention will be concretely detailed with reference to the examples thereof. However, the embodiments of the invention shall not be limited thereto. In the following descriptions, the abbreviation will be made as follows; namely, cyclohexyl methacrylate to CHMA, methyl methacrylate to MMA, polycyclohexyl methacrylate to PCHMA, polymethyl methacrylate to PMMA, styrerie to St, polystyrene to PSt, butyl methacrylate to BMA and butyl acrylate to BAt respectively.

Process of preparing a toner applicable to the examples and comparative examples A polyester having an acid value of 49, that was synthesized of each monomer of 33 mol % of neopentyl glycol, 17 mol % of ethylene glycol, 37 mol % of terephthalic acid and 13 mol % of trimellitic acid anhydride, 8 parts by weight of carbon black, 2 parts by weight of purified carnauba wax No. 1 (manufactured by Noda Wax Co.) and 2 parts by weight of ethylene bisstearic acid amide were mixed up, kneaded, cooled down, pulverized and classified, so that colored fine particles having an average particle size of 8.0 μm could be prepared. The resulting colored fine particles were added externally by 0.6% by weight of hydrophobic silica (having the primary particle size of 12 nm) and 0.8% by weight of hydrophobic titanium (having the primary particle size of 25 nm), so that toner-1 could be prepared.

Example-1

First, In an aqueous medium solution applied with sodium benzenesulfonate having an alkyl group having 12 carbon atoms as a surfactant, the concentration thereof was set to be 0.3% by weight, and a copolymer of CHMA/MMA was synthesized (so as to have a copolymerization ratio of 5/5), so that fine resin particles having a volumetric average primary particle size of 0.1μm, a weight average molecular weight (Mw) of 200,000, a number average molecular weight (Mn) of 91,000, Mw/Mn=2.2, a softening point temperature (Tsp) of 230° C. and a glass transition temperature (Tg) of 110° C. could be prepared. The resulting fine resin particles were subjected to an azeotropy with water in the emulsified state and the amount of the residual monomers was then set to be 510 ppm.

Next, 100 parts by weight of separately prepared carrier core members comprising Cu-zn ferrite particles having a volumetric average primary particle size of 60 μm and a saturation-magnetization of 63 emu/g and 2 parts by weight of the above-mentioned fine resin particles were put into a high-speed stirring mixing machine attached with stirring blades, that is shown in FIG. 1, and they were mixedly stirred at 120° C. for 30 minutes, so that resin-coated carrier could be prepared by applying the functions of mechanical impact thereto. The amounts of the resulting residual monomers and residual surfactants were proved to be 150 ppm and 24 ppm, respectively, to the whole coated resin of the resulting resin-coated carrier.

Toner-1 and the resin-coated carriers each mentioned above were mixed up together, so that developer 1 applicable to example 1, that had a toner concentration of 6%, could be prepared.

Examples 2 to 8

Developers 2 to 8 for examples 2 to 8 were prepared respectively in the same manner as in the case of example 1, except that the resin for forming a carrier coated layer was used in the proportion shown in Table 1 and that the composition of fine resin particles obtained of the resin, the core member of the carrier, the material temperature and the stirring time each in the course of a high-speed stirring operation and the toner concentration were each changed as shown in Table 2.

The amount of the monomer remained in the fine resin particles of examples 1 to 8 each obtained as described above, and the proportions of the amounts of the remaining monomer and the remaining surfactant each to the whole amount of the coated resin were shown in Table 3.

Comparative Examples 1 to 4

Developers 9 to 12 for comparative examples 1 to 4 were prepared respectively in the same manner as in the case of example 1, except that the resin for forming a carrier coated layer was used in the proportion shown in Table 1 and that the composition of fine resin particles obtained of the resin, the core member of the carrier, the material temperature and the stirring time each in the course of a high-speed stirring operation and the toner concentration were each changed as shown in Table 2.

TABLE 1

CHA means cyclohexylacrylate

| Developer No. | | Proportion of the resin for carrier coated layer use |
|---|---|---|
| For inventive example | Developer 1 | CHMA/MMA Copolymer w/a copolymerizing ratio of 5/5 |
| | Developer 2 | CHMA/MMA Copolymer w/a copolymerizing ratio of 3/7 |
| | Developer 3 1 | CHMA/MMA/BMA Copolymer w/a copolymerizing ratio of 6/3/1 |
| | Developer 4 | CHMA/MMA Copolymer w/a copolymerizing ratio of 8/2 |
| | Developer 5 | CHMA/MMA/St Copolymer w/a copolymerizing ratio of 4/2/4 |
| | Developer 6 | Fine resin particles of PCHMA/Fine resin particles of PMMA blending ratio of 7/3 |
| | Developer 7 | Fine particles of PCHMA/Fine resin particle of PMMA/Fine resin particle of PSt blending ratio of 5/3/2 |
| | Developer 8 | CHMA/MMA Copolymer w/a copolymerizing ratio of 5/5 |
| For comparative example | Developer 9 | MMA/ST Copolymer w/a copolymerizing ratio of 6/4 |
| | Developer 10 | CHMA/ST Copolymer w/a copolymerizing ratio of 3/7 |
| | Developer 11 | CHA independent polymer |
| | Developer 12 | MMA/BA Copolymer w/a copolymerizing ratio of 75/25 |

TABLE 3

| Developer No. | Residual monomer in fine resin particles (ppm) | Residual monomer to the whole coated resin (ppm) | Residual surfactant to the whole coated resin (ppm) |
|---|---|---|---|
| Developer 1 | 510 | 150 | 24 |
| Developer 2 | 400 | 120 | 128 |
| Developer 3 | 860 | 470 | 35 |
| Developer 4 | 2080 | 920 | 10 |
| Developer 5 | 170 | 80 | 360 |
| Developer 6 | 230 | 100 | 170 |
| Developer 7 | 340 | 160 | 87 |
| Developer 8 | 480 | 140 | 26 |

Evaluation procedures

The above-mentioned 11 kinds of developers were put alternately in a U-Bix 5070 copying machine (manufactured by Konica Corp.) loaded with a toner-recycling mechanism, and every 100,000th copying test was tried respectively under the conditions of 20° C. and 50%RH. The developers were samples after every 10,000th test and, for checking up the refresh effect, the aforementioned toner-1 was added to the carrier from which a toner was removed so that the specified toner concentration could be obtained. The resulting mixture of the carrier and toner was then so shaken for 5 minutes as to be frictionally charged by making use of a shaking device, "New YS-80" (manufactured by Yayoi Co.). The resulting charged amount was measured in a blow-off

TABLE 2

| | Developer No. | | Composition of fine resin particles forming a carrier coated layer: Volume average primary particle size (μm) | Mw | Mn | Mw/Mn | Tsp (°C.) | Tg (°C.) | Composition of carrier core member: Core member | Volume average primary particle size (μm) | Saturation-magnetization (emu/g) | Toner concentration (%) |
|---|---|---|---|---|---|---|---|---|---|---|---|---|
| For inventive example | Developer 1 | Copolymer | 0.10 | 200,000 | 91,000 | 2.2 | 230 | 110 | Cu—Zn ferrite | 60 | 63 | 6 |
| | Developer 2 | Copolymer | 0.09 | 410,000 | 103,000 | 4.0 | 246 | 112 | Cu—Zn ferrite | 60 | 63 | 6 |
| | Developer 3 | Copolymer | 0.12 | 250,000 | 125,000 | 2.0 | 210 | 96 | Cu—Zn ferrite | 50 | 63 | 7 |
| | Developer 4 | Copolymer | 0.08 | 690,000 | 380,000 | 1.8 | 292 | 95 | Magnetite | 45 | 76 | 8 |
| | Developer 5 | Copolymer | 0.18 | 50,000 | 6,400 | 7.8 | 174 | 98 | Magnetite | 45 | 76 | 8 |
| | Developer 6 | PCHMA | 0.10 | 290,000 | 97,000 | 3.0 | 205 | 80 | Cu—Zn ferrite | 75 | 63 | 5 |
| | | PMMA | 0.10 | 400,000 | 180,000 | 2.2 | 268 | 105 | | | | |
| | Developer 7 | PCHMA | 0.10 | 290,000 | 97,000 | 3.0 | 205 | 80 | Magnetite | 60 | 63 | 8 |
| | | PMMA | 0.10 | 400,000 | 180,000 | 2.2 | 268 | 105 | | | | |
| | | PSt | 0.10 | 250,000 | 64,000 | 3.9 | 235 | 101 | | | | |
| | Developer 8 | Copolymer | 0.10 | 530,000 | 230,000 | 2.3 | 265 | 110 | Cu—Zn ferrite | 60 | 63 | 6 |
| For comparative example | Developer 9 | Copolymer | 0.09 | 300,000 | 25,000 | 12.2 | 225 | 102 | Cu—Zn ferrite | 60 | 63 | 6 |
| | Developer 10 | Copolymer | 0.08 | 300,000 | 28,000 | 10.8 | 200 | 98 | Cu—Zn ferrite | 60 | 63 | 6 |
| | Developer 11 | Polymer | 0.12 | 400,000 | 27,000 | 15.0 | 158 | 40 | Cu—Zn ferrite | 60 | 63 | 6 |
| | Developer 12 | Copolymer | 0.10 | 400,000 | 36,000 | 11.1 | 205 | 62 | Cu—Zn ferrite | 60 | 63 | 6 |

method, and the melting adhesion of a toner particle to a carrier and a coated layer delamination were observed through a scanning electron microscope. A developer sampled at the 10,000th copying test was allowed to stand for 2 hours under the conditions of 40° C. and 90% RH and was then shaken for 5 minutes by a shaking machine "New YS-80" (manufactured by Yayoi Co.) so as to be frictionally charged. The resulting charged amount was measured in a blow-off method and the result of the measurement was regarded as a initial charged amount (in (μC/g). Next, the same sample was allowed to stand for 6 hours under the conditions of 40° C. and 90% RH so that the charged amount was decayed. The resulting decayed charged amount in (μC/g) was similarly measured in a blow-off method. The value obtained therefrom and the initial charged amount will be shown in Table 2.

In addition to the above, the decaying degrees (%) was calculated out of the initial charged amount and the charged amount after allowing to sand for 6 hours, according to the following formula. The results thereof will be shown in Table 4.

$$\text{Charged amount decay (\%)} = \{(\text{Initial charged amount} - \text{6 hours charged amount})/(\text{Initial charged amount})\} \times 100$$

TABLE 4

| | | 20° C., RH50% | | | | | 40° C., RH90% | | |
|---|---|---|---|---|---|---|---|---|---|
| | | Charged amount (μC/g) | | | Toner spent after | Layer delamination after | Charged amount (μC/g) | | |
| Example No. | Developer No. | Initial stage | at 50,000th copy | at 100,000th copy | 100,000th copy | 100,000th copy | Initial | After 6 hrs | Decay (%) |
| Inventive example 1 | Developer 1 | 26.3 | 26.1 | 25.9 | Almost not spent | Almost not delami-nated | 20.1 | 20.0 | 0.5 |
| Inventive example 2 | Developer 2 | 25.9 | 25.7 | 25.2 | Almost not spent | Almost not delami-nated | 19.8 | 19.5 | 1.5 |
| Inventive example 3 | Developer 3 | 27.8 | 26.2 | 26.2 | Almost not spent | Almost not delami-nated | 22.6 | 22.0 | 2.7 |
| Inventive example 4 | Developer 4 | 27.8 | 26.0 | 24.8 | Almost not spent | Almost not delami-nated | 23.5 | 23.4 | 0.4 |
| Inventive example 5 | Developer 5 | 26.5 | 24.1 | 23.4 | Almost not spent | Almost not delami-nated | 21.0 | 20.8 | 1.0 |
| Inventive example 6 | Developer 6 | 27.4 | 26.9 | 26.8 | Almost not spent | Almost not delami-nated | 23.8 | 23.8 | 0 |
| Inventive example 7 | Developer 7 | 26.0 | 25.7 | 25.5 | Almost not spent | Almost not delami-nated | 22.2 | 22.0 | 0.9 |
| Inventive example 8 | Developer 8 | 26.7 | 26.4 | 26.4 | Almost not spent | Almost not delami-nated | 21.0 | 20.7 | 0.3 |
| Comparative example 1 | Developer 9 | 20.9 | 14.2 | 10.1 | Many spent | Some delamination found | 16.0 | 11.1 | 30.6 |
| Comparative example 2 | Developer 10 | 18.5 | 11.0 | 8.8 | Seriously spent | Many delamination found | 13.7 | 9.6 | 29.9 |
| Comparative example 3 | Developer 11 | 22.5 | 16.9 | 9.2 | Seriously spent | Many delamination found | 20.5 | 10.2 | 50.2 |
| Comparative example 4 | Developer 12 | 20.0 | 15.1 | 11.9 | Many spent | Almost not delami-nated | 18.2 | 7.3 | 10.9 |

From the contents of Table 4, the following facts were proved. In the inventive examples, each of the developers each having a carrier relating to the invention was used. Therefore, a fatigue and deterioration produced in the long-term courses of image formation; such as a carrier layer delamination, a charge leakage produced by a moisture absorption and a toner spent, can be eliminated, so that a high image quality can stably and effectively be obtained extending over a long period of time. In contrast thereto, in the comparative examples, the fatigue and deterioration such as the above-mentioned carrier layer delamination, charge leakage and toner spent were seriously produced, so that, resultingly, the image quality was so deteriorated that the comparative developers cannot be used practically.

As is obvious from the above descriptions, according to a carrier of the invention for electrophotographic use, the following advantages can be enjoyed. There is no defect such as a coated-layer delamination from the carrier, a toner spent and a potential leakage produced by a moisture absorption and, particularly, the refreshment of a carrier coated layer can be performed when making long-term use, so as to make it constantly excellent in fluidity, chargeability and developability of a developer constantly restorable to display the initial characteristics, and every high image quality can be obtained with a high durability and stability extending over a long period of time.

What is claimed is:

1. A carrier for electrophotographic use having a resin-coated layer on the surface of the core member thereof, wherein said coated layer contains a copolymer having a Tg of 60° to 180° C. comprising a cyclohexyl methacrylate first monomer unit, with a second monomer unit of methylmethacrylate, ethylmethacrylate, propylmethacrylate, n-butylmethacrylate, hexylmethacrylate, octylmethacrylate or 2-ethylhexylmethacrylate and contains unpolymerized monomers in an amount of 10 to 2000 ppm relative to the whole coated layer and a surfactant in an amount of 5 to 1000 ppm relative to the whole coated layer.

2. The carrier for electrophotographic use as claimed in claim 1, wherein the copolymer has a mole ratio of the cyclohexyl methacrylate first monomer unit to the second monomer unit of 1:9 to 9:1.

3. The carrier for electrophotographic use as claimed in claim 2, wherein the copolymer has a mole ratio of the cyclohexyl methacrylate first monomer unit to the second monomer unit of 3:7 to 7:3.

4. The carrier for electrophotographic use as claimed in claim 3, wherein said resin coated layer contains said copolymer in an amount of 50 weight % or more.

5. The carrier for electrophotographic use as claimed in claim 1, wherein the copolymer has a weight average molecular weight of 10,000 to 800,000.

6. The carrier for electrophotographic use as claimed in claim 1, wherein the copolymer has a Mw/Mn ratio of 1.5 to 10.

7. The carrier for electrophotographic use as claimed in claim 1, wherein the copolymer has a softening point of 150° to 300° C.

8. The carrier for electrophotographic use as claimed in claim 1, wherein the copolymer has a moisture content of 0.1 to 1.0 weight % at 22° C. and 55% RH.

9. The carrier for electrophotographic use as claimed in claim 1, wherein the copolymer has a Tg of 80° to 150° C.

10. A carrier for electrophotographic use having a resin-coated layer on the surface of the core member thereof, wherein said coated layer contains a mixture of a first polymer having a Tg of 60° to 180° C. comprising a cyclohexyl methacrylate monomer unit, and a second polymer having a Tg of 60° to 180° C. comprising a methylmethacrylate monomer unit, and contains unpolymerized monomers in an amount of 10 to 2000 ppm relative to the whole coated layer and a surfactant in an amount of 5 to 1000 ppm relative to the whole coated layer.

11. The carrier for electrophotographic use as claimed in claim 10, wherein the content ratio by weight of the first polymer to the second polymer is 1:9 to 9:1.

12. The carrier for electrophotographic use as claimed in claim 11, wherein the content ratio by weight of the first polymer to the second polymer is 3:7 to 7:3.

13. The carrier for electrophotographic use as claimed in claim 12, wherein said resin coated layer contains said first and second polymers in an amount of 50 weight % or more.

14. The carrier for electrophotographic use as claimed in claim 10, wherein the first and second polymers each have a weight average molecular weight of 10,000 to 800,000.

15. The carrier for electrophotographic use as claimed in claim 10, wherein the first and second polymers each have a Mw/Mn ratio of 1.5 to 10.

16. The carrier for electrophotographic use as claimed 10, wherein the first and second polymers each have a softening point of 150° to 300° C.

17. The carrier for electrophotographic use as claimed in claim 10, wherein the first and second polymers each have a moisture content of 0.1 to 1.0 weight % at 22° C. and 55% RH.

18. The carrier for electrophotographic use as claimed in claim 10, wherein the first and second polymers each have a Tg of 80° to 150° C.

19. A carrier for electrophotographic use having a resin-coated layer on the surface of the core member thereof, wherein said coated layer containing a copolymer having a Tg of 80° to 150° C. and having a weight average molecular weight of 10,000 to 800,000 obtained by copolymerizing cyclohexyl methacrylate with methylmethacrylate, ethylmethacrylate, propylmethacrylate, n-butylmethacrylate, hexylmethacrylate, octylmethacrylate or 2-ethylhexyl-methacrylate, and containing unpolymerized monomers in an amount of 10 to 2000 ppm relative to the whole coated layer and a surfactant in an amount of 5 to 1000 ppm relative to the whole coated layer.

* * * * *